US005653818A

United States Patent [19]

Genardi

[11] Patent Number: 5,653,818

[45] Date of Patent: Aug. 5, 1997

[54] LOTTERY TICKET SCRAPER AND METHOD OF USE

[76] Inventor: Ronald S. Genardi, 1141 Main Ave., Clifton, N.J. 07011

[21] Appl. No.: 494,096

[22] Filed: Jun. 23, 1995

[51] Int. Cl.[6] ..... B08B 1/00; A47L 13/02

[52] U.S. Cl. ..... 134/6; 15/236.01; 15/236.05; 7/165; 30/172; 81/439; D8/19; D32/46

[58] Field of Search ..... 15/236.01, 236.05, 15/105.5, 105; 30/169, 172; 7/165; 81/439; D3/208, 210; D8/16, 19, 20, 85, 86; D32/46–49; 134/6

[56] References Cited

U.S. PATENT DOCUMENTS

| | | | |
|---|---|---|---|
| D. 204,660 | 5/1966 | Vuotto | D8/19 |
| D. 229,390 | 11/1973 | Hart | D8/85 |
| D. 267,281 | 12/1982 | Mottl et al. | D32/46 |
| D. 290,056 | 5/1987 | Hatfield | D3/210 |
| D. 290,057 | 5/1987 | Licher | D32/46 |
| D. 302,880 | 8/1989 | Terry | D32/46 |
| D. 312,155 | 11/1990 | Saunders | D32/46 |
| D. 323,045 | 1/1992 | Gabler | D32/46 |
| 2,788,816 | 4/1957 | Dargols | 81/439 |
| 4,037,275 | 7/1977 | Schor | 7/165 |
| 4,646,382 | 3/1987 | Smith | 15/236.01 |
| 4,662,518 | 5/1987 | Chiappetta et al. | 206/449 |
| 4,698,870 | 10/1987 | Clark | 15/105.5 |
| 4,908,899 | 3/1990 | Killen | 15/105 |
| 5,127,720 | 7/1992 | Shultz | 312/229 |

FOREIGN PATENT DOCUMENTS

| | | | |
|---|---|---|---|
| 923263 | 7/1947 | France | 81/439 |
| 610478 | 10/1948 | United Kingdom | 81/439 |

*Primary Examiner*—Mark Spisich
*Attorney, Agent, or Firm*—Walter J. Tencza, Jr.

[57] ABSTRACT

The present invention provides a better lottery ticket scraper. In one form of the invention a substantially circular disk is provided. The edge of the substantially circular disk is integral with at least one flat smooth protrusion. Preferably, the circular disk has four protrusions integral to its edge, each located integral with a pole of the circular disk. The four protrusions each may have the same thickness as the circular disk, or each may be bevelled outward from the disk to a thin edge. In addition, the protrusions may have one surface integral with one surface of the circular disk and the other surface perpendicular to the outer edge of the circular disk.

8 Claims, 1 Drawing Sheet

LOTTERY TICKET SCRAPER AND METHOD OF USE

FIELD OF THE INVENTION

This invention relates to the field of lottery ticket scrapers.

Background of the Invention

Various designs are shown in the art for scraping lottery tickets. Gabler, Des. 323,045, discloses a clover shaped lottery ticket scraper. Terry, Des. 302,880, discloses a lottery ticket scraper with a sharp bevelled edge. Saunders, Des. 312,155 and Licher, Des. 290,057, also disclose various types of lottery ticket scrapers.

SUMMARY OF THE INVENTION

The present invention provides a better lottery ticket scraper. In one form of the invention a lottery ticket scraper comprising a substantially circular disk and at least on protrusion is provided. The protrusion has a smooth bottom surface and a smooth top surface. Each surface is bounded by an outer line segment, two perpendicular line segments, and an arc which is integral with an edge of the substantially circular disk.

Preferably, the lottery ticket scraper comprises four protrusions, wherein if one protrusion is located at the north pole of the disk, the other three protrusions are located at the south, east, and west poles of the disk. The four protrusions each may have the same thickness as the circular disk, or each may have a gradually decreasing thickness, from a maximum at the arc of the protrusion to disk to a minimum at the outer line segment of the protrusion. In addition, the protrusions may have one surface integral with one surface of the circular disk and the other surface perpendicular to the outer edge of the circular disk.

The present invention has advantages in that the disk is easy to grasp. The flat protrusions provide easy scratch off ability. The multiple protrusion embodiment provides a user with another edge when one edge becomes worn. The lottery ticket scraper can be made out of metal or plastic. Cast aluminum would be an appropriate type of metal to be used.

DETAILED DESCRIPTION OF THE DRAWINGS

Figure 1:
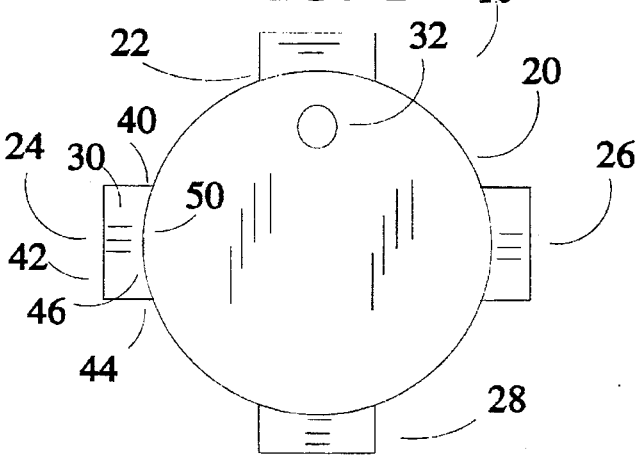
FIG. 1 is a top view of a lottery ticket scraper comprised of a substantially circular disk and protrusions.
Figure 2:
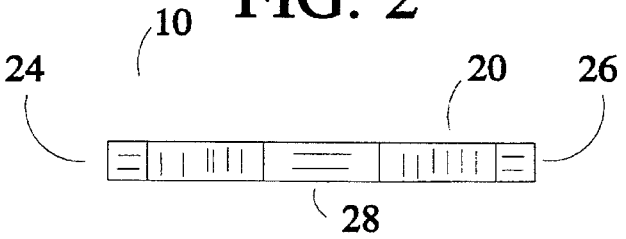
FIG. 2 is a side view of a lottery ticket scraper having protrusions of the same thickness as the disk.

FIGS. 1 and 2 shows a lottery ticket scraper 10 in accordance with the present invention. FIG. 1 shows a top view of lottery ticket scraper 10 and FIG. 2 shows a side view. Lottery ticket scraper 10 is comprised of circular disk 20 and protrusions 22, 24 26, and 28. Each protrusion has a smooth top and bottom surface 30. Each surface 30 is surrounded on one side by an outer line segment 42, by two sides by parallel line segments 40 and 44 which are substantially perpendicular to the outer edges 50 of the disk 20 and on a fourth side by an arc 46. The arc 46 is substantially integral with the outer edge 50 of the circular disk 20. The lottery ticket scraper 10 can be manufactured from a single mold. The lottery ticket scraper 10 also preferably includes a key chain hole 32. The key chain hole 32 may be punched through any spot on the lottery ticket scraper 10.

The protrusions are located so that if protrusion 22 is pointed in the northern direction, protrusion 24 is pointed in the west, protrusion 26 is pointed in the east and protrusion 28 is pointed in the south.

Figure 3:
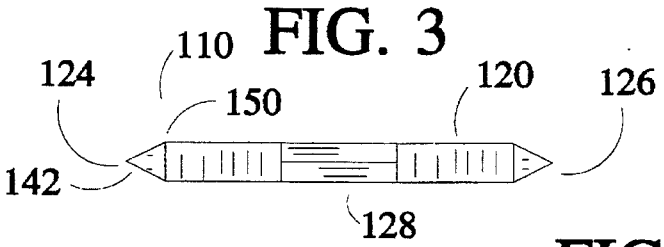
FIG. 3 is a side view of a lottery ticket scraper having protrusions with gradually decreasing thickness.

FIG. 3 shows a side view of a second embodiment of the present invention, lottery ticket scraper 110. The top view of lottery ticket scraper 110 is similar to lottery ticket scraper 10, shown in FIG. 1. Lottery ticket scraper 110 has a circular disk 120 and four protrusions, 122, 124, 126, and 128. One of these protrusions, 122, is not shown, in FIG. 3. Lottery ticket scraper 110 differs from lottery ticket scraper 10 in that each protrusion starts out with a thickness equal to the circular disk 120 at the edge 150 and is bevelled to a thin outer segment 142.

Figure 4:
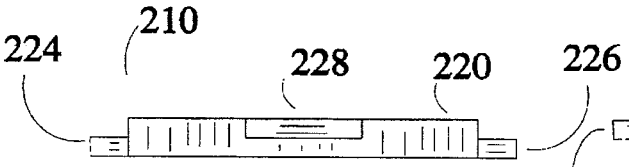
FIGS. 4 and 5 are side views of a lottery ticket scraper having protrusions with uniform thicknesses which are thinner than the disk.
Figure 5:
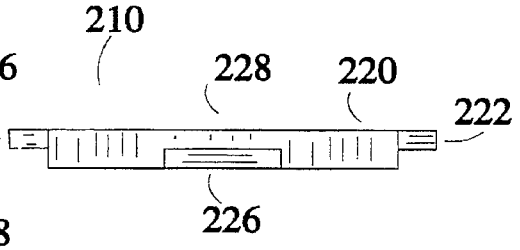

FIGS. 4 and 5 show side views of lottery ticket scraper 210. Lottery ticket scraper 210 also has a top view similar to scrapers 10 and 110. Lottery ticket scraper 210 includes circular disk 220, and protrusions 222, 224, 226, and 228. Each protrusion has a uniform thickness which is less than the thickness of the circular disk 220. In addition, each protrusion has one of its surfaces integral with the top or bottom surface of the disk 220 and the other surface perpendicular with the edge of the disk 220. The protrusions are preferably alternated so that the protrusions 222 and 228 have their top surfaces integral with the top surface of the disk 220, and the protrusions 224 and 226 have their bottom surfaces integral with the bottom surface of the disk 220.

The lottery ticket scraper can be made out of metal or plastic. Cast aluminum would be an appropriate type of metal to be used.

I claim:

1. A lottery ticket scraper comprising:

a substantially circular disk having an outer edge; and a first and second protrusion each protrusion having a smooth top surface and a smooth bottom surface, each surface bounded by four sides, the first side being an outer line segment, the second and third sides being parallel line segments which are substantially perpendicular to the outer edge of the disk, and the fourth side being substantially integral with the outer edge of the substantially circular disk;

and wherein the first and second protrusions each have a substantially uniform thickness which is thinner than the disk.

2. The lottery ticket scraper of claim 1 further comprising:

a third protrusion having a smooth top surface and a smooth bottom surface, each surface bounded by four sides, the first side being an outer line segment, the second and third sides being parallel line segments which are substantially perpendicular to the outer edge of the disk, and the fourth side being substantially integral with the outer edge of the substantially circular disk;

and wherein the third protrusion has a substantially uniform thickness which is thinner than the disk.

3. The lottery ticket scraper of claim 2 further comprising:

a fourth protrusion having a smooth top surface and a smooth bottom surface, each surface bounded by four sides, the first side being an outer line segment, the second and third sides being parallel line segments which are substantially perpendicular to the outer edge of the disk, and the fourth side being substantially integral with the outer edge of the substantially circular disk;

and wherein the fourth protrusion has a substantially uniform thickness which is thinner than the disk.

4. The lottery ticket scraper of claim 3 wherein:

the protrusions are located integral with the substantially circular disk so that when the first protrusion points north, the second, third, and fourth protrusions point south, east, and west respectively.

5. The lottery ticket scraper of claim 3 wherein:

the substantially circular disk has a top surface and a bottom surface; and the top surfaces of the first and second protrusions are integral with the top surface of the disk and the top surfaces of the third and fourth protrusions are integral with the bottom surface of the disk.

6. A method of use for a substantially circular disk having an outer edge and a first and second protrusion each protrusion having a smooth top surface and a smooth bottom surface, each surface bounded by four sides, the first side being an outer line segment, the second and third sides being parallel line segments which are substantially perpendicular to the outer edge of the disk, and the fourth side being substantially integral with the outer edge of the substantially circular disk; and wherein the first and second protrusions each have a substantially uniform thickness which is thinner than the disk;

the method comprising:

holding the disk;

using the first protrusion to scrape off a lottery ticket; and and using the second protrusion to scrape off a lottery ticket.

7. The method of claim 6 and wherein the substantially circular disk has a third protrusion having a smooth top surface and a smooth bottom surface, each surface bounded by four sides, the first side being an outer line segment, the second and third sides being parallel line segments which are substantially perpendicular to the outer edge of the disk, and the fourth side being substantially integral with the outer edge of the substantially circular disk; and wherein the third protrusion has a substantially uniform thickness which is thinner than the disk;

the method further comprising:

using the third protrusion to scrape off a lottery ticket.

8. The method of claim 7 and wherein the substantially circular disk has a fourth protrusion having a smooth top surface and a smooth bottom surface, each surface bounded by four sides, the first side being an outer line segment, the second and third sides being parallel line segments which are substantially perpendicular to the outer edge of the disk, and the fourth side being substantially integral with the outer edge of the substantially circular disk; and wherein the fourth protrusion has a substantially uniform thickness which is thinner than the disk;

the method further comprising:

using the fourth protrusion to scrape off a lottery ticket.

* * * * *